United States Patent [19]

Bohrmann

[11] Patent Number: 4,864,803

[45] Date of Patent: Sep. 12, 1989

[54] APPARATUS FOR PACKAGING COMPRESSIBLE ARTICLES

[75] Inventor: Kurt Bohrmann, Altdorf, Fed. Rep. of Germany

[73] Assignee: Paper Converting Machine GmbH, Schifferstadt, Fed. Rep. of Germany

[21] Appl. No.: 216,383

[22] Filed: Jul. 7, 1988

[30] Foreign Application Priority Data

Jul. 24, 1987 [DE] Fed. Rep. of Germany ..... 3724493

[51] Int. Cl.[4] ..... B65B 5/06; B65B 63/02

[52] U.S. Cl. ..... 53/527; 53/528; 53/540

[58] Field of Search ..... 53/527, 528, 526, 523, 53/436, 439, 540, 531, 447

[56] References Cited

U.S. PATENT DOCUMENTS

| | | | |
|---|---|---|---|
| 3,530,644 | 9/1970 | Kapare . | |
| 4,108,063 | 8/1978 | Randolph | 100/53 |
| 4,535,587 | 8/1985 | Rias | 53/447 X |
| 4,553,668 | 11/1985 | James et al. | 53/527 |
| 4,679,379 | 7/1987 | Cassoli | 53/447 X |
| 4,805,383 | 2/1989 | Allwein | 53/528 |

FOREIGN PATENT DOCUMENTS 1003443 3/1979 United Kingdom .

*Primary Examiner*—James F. Coan

*Attorney, Agent, or Firm*—Frishauf, Holtz, Goodman & Woodward

[57] ABSTRACT

To retain compressible articles such as paper towels, toilet paper and the like tightly compressed in a weldable foil, a feeding push element (3) pushes the articles into a bag and, in accordance with the invention, the bottom of the bag is yieldingly restrained to permit movement of the articles into the bag while displacing the bag against a yielding force. When the bag is filled, the counter abutment plate (6) adjacent the bottom of the bag has reached a limit or terminal position, so that articles in the bag are compressed. Hold-down elements then close over the still open end of the bag, permitting sealing of the still open bag while the articles are retained compressed. The abutment plate can then be moved out of position for further transport of the filled bag with the material retained therein in compressed condition.

10 Claims, 2 Drawing Sheets

APPARATUS FOR PACKAGING COMPRESSIBLE ARTICLES

The present invention relates to an apparatus or machine to package compressible articles, such as kitchen paper towels, toilet paper and the like, in a foil bag, typically a plastic foil bag, and more particularly to such an apparatus in which a group or assembly of products are supplied, approximately horizontally, into an open foil bag in one row or a plurality of parallel rows, and especially to such an apparatus permitting tight packing of the articles within the bag.

BACKGROUND

Compressible products or articles, for example compressible paper rolls, such as toilet paper, kitchen paper towels or the like, are usually packaged by assembling a plurality of individual packages or rolls in a predetermined formation to form a group or assembly, and then introducing this group or assembly by a plunger, push rod, piston or similar element into an open foil bag. The foil bag is frequently made on the packaging machine by leaidng together two foil webs which are supplied to the machine from the top and the bottom, and are laterally welded together. Other types of machines are known in which the foil bags are supplied to the machine, or different bags are made by the packaging machine.

Paper products of this type are relatively soft. It is known to compress the paper products during the filling steps by means of brushes or the like, so that the plastic bag is pressed against the paper products and then only is it welded shut. The brushes are usually applied only against the upper web of foil if two foil webs are used; the lower web of foil is already tightly engaged with the products merely by its position, usually on a table, platform, or transport arrangement.

Compressible products are difficult to package in foil bags so that the products are compressed and tightly fit into the bag.

THE INVENTION

It is an object to improve a packaging apparatus so that even soft substantially yielding products can be packaged securely and tightly in foil bags to be firmly retained therein, so that the foil material of the foil bag surrounds the product tautly.

Briefly, a counter abutment element is located outside of the bag, and adjacent the bottom wall, the counter element being movable in feeding direction of the articles, while being restrained from such movement by a force directed opposite to the feeding direction, and less than the feeding force, to provide a yieldable counter force against the feeding element while causing compression of the articles in the bag.

The counter abutment element is so positioned that it is engaged by the bottom of the bag as the products are pushed therein and, consequently, while the products are being introduced into the bag. This securely places the products first against an insertion plunger and, already during the introduction step, for example by the plunger, some compression is applied against the products. The filled bag is then closed, for example by heat welding or the like, at its fill end. This results in the products being retained in the bag substantially tighter and stiffer than heretofore. Preferably, the counter force, against which the products are compressed during the insertion step, is adjustable in accordance with the characteristics or nature of the products and the compression force to be applied. Such a counter force can be generated by springs or the like; it is particularly desirable, however, in accordance with a feature of the invention, to obtain the counter force by a piston-cylinder arrangement, since such apparatus can be easily matched to different lengths of bags and to different compression forces.

The abutment or counter element can be guided on a track or the like extending in the feeding direction of the products, to permit yielding movement thereof subject to the counter force being applied by the counter abutment element. In accordance with a feature of the invention, the counter abutment elements can be moved out of the path of the filled bag so that the bag, after closing, can be further transported in the direction of the feeding movement of the articles introduced therein. This permits a particularly simple arrangement for transporting of the filled bags. Various arrangements can be used to remove the counter element from the path of the filled bag. In accordance with a simple arrangement, the counter abutment element is pivotably coupled to the guide track which permits displacement of the counter element so that, after insertion of the articles and after the compressing effect by the counter element is no longer needed, it can be easily moved out of the path of the filled bag and permit further transport thereof. Various arrangements can be used to pivot the counter abutment element out of the way of the filled bag; a cylinder-piston arrangement has been found particularly suitable.

DRAWINGS

Illustrating an exemplary embodiment:

FIG. 1 is a highly schematic side view of the apparatus, and illustrating the position of the elements thereof upon insertion of articles into a bag; and FIG. 2 is a view similar to FIG. 1 at the end of the filling step.

DETAILED DESCRIPTION

The drawings are highly schematic and illustrate only those features necessary for an understanding of the present invention.

Figure 1:
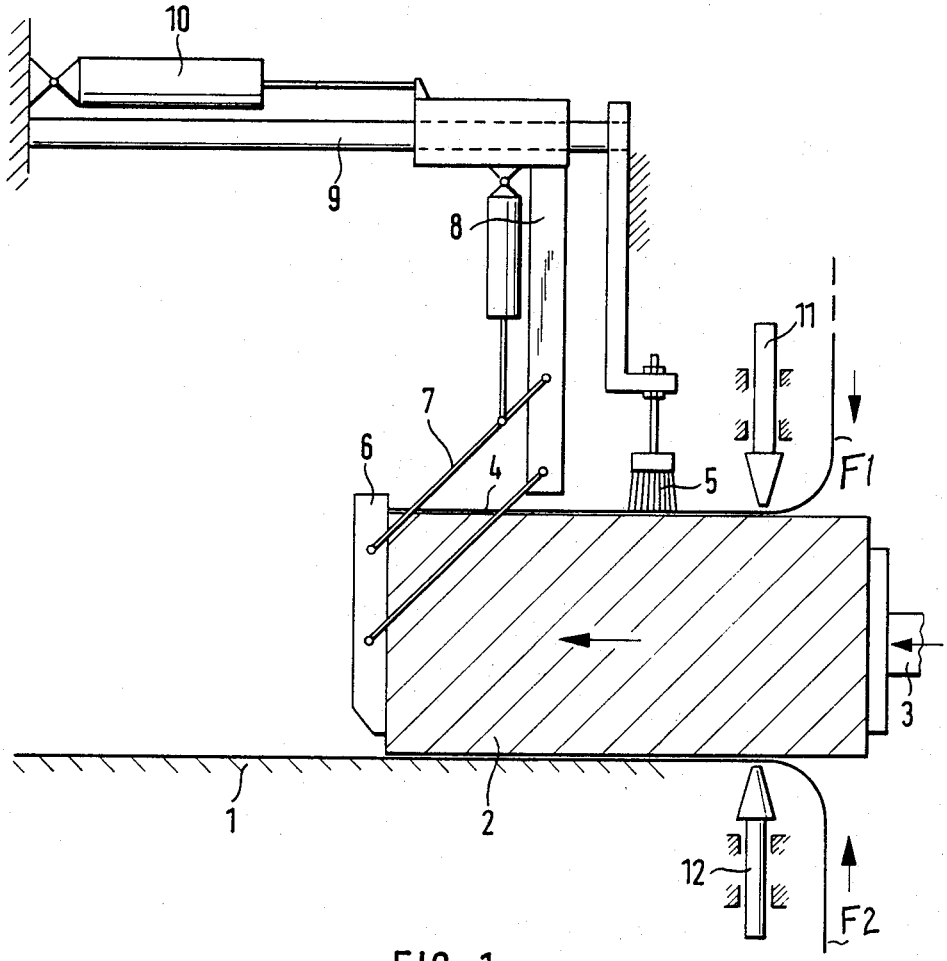

FIG. 1 shows a support 1 on which products 2, for example a group of kitchen paper towels, stacked vertically, are moved from right towards left. Movement is, as frequently done, effected by a pusher or plunger 3 which pushes the products, in groups or assemblies, against depending foils, and thus forms an upper and a lower foil portion. Alternatively, foil F1, F2 can be provided, one each supplied from the top and bottom, and suitably welded together at the sides by apparatus, well known and not shown in the drawings for clarity. Other ways of forming the foil can be used. Basically, movement of the products 2 pushes the foil or the foils F1, F2 from right to left while the bag is being made at the sides.

A brush 5 is provided, engaging against the upper foil web F1 to provide for tight engagement of the products 2 against the upper foil web.

In accordance with the invention, a counter abutment plate 6 is located at the bottom wall end of the bag 4 which is being formed. The bottom end abuts against the abutment element or plate 6. The plate 6 is movable in the direction of the insertion movement of the products.

The counter abutment plate 6 is pivotably retained by a parallel-link arrangement on a depending arm 8, secured to a carriage which travels on suspended rails 9, extending in the direction of feed movement of the plunger or pusher element 3. The abutment plate 6, thus, is movable in the direction of the feed movement of the pusher element 3.

The counter or back-up plate 6 can be controlled with respect to its position, as well as with respect to the counteracting force, simply and, in accordance with a feature of the invention, by forming the counter-acting force as a pneumatically operating compression cylinder 10, which may be similar to a dash-pot. Thus, the depending arm 8 is coupled by a suitable push rod, link or the like to a piston operating within cylinder 10. The counter force, exerted by the piston-cylinder arrangement 10,is so set that the bottom of the bag 4 engages the counter plate 6 before the filling process has terminated. This ensures that air within the bag has sufficient time to escape. Upon continued filling, the bag pushes the counter element 6 towards the left (FIG. 1), passively, under action of the push element 3. The cylinder-piston arrangement 10 provides a predetermined counter force, so that the products 2 being filled in the bag 4 will be subjected to a desired compression force.

Figure 2:
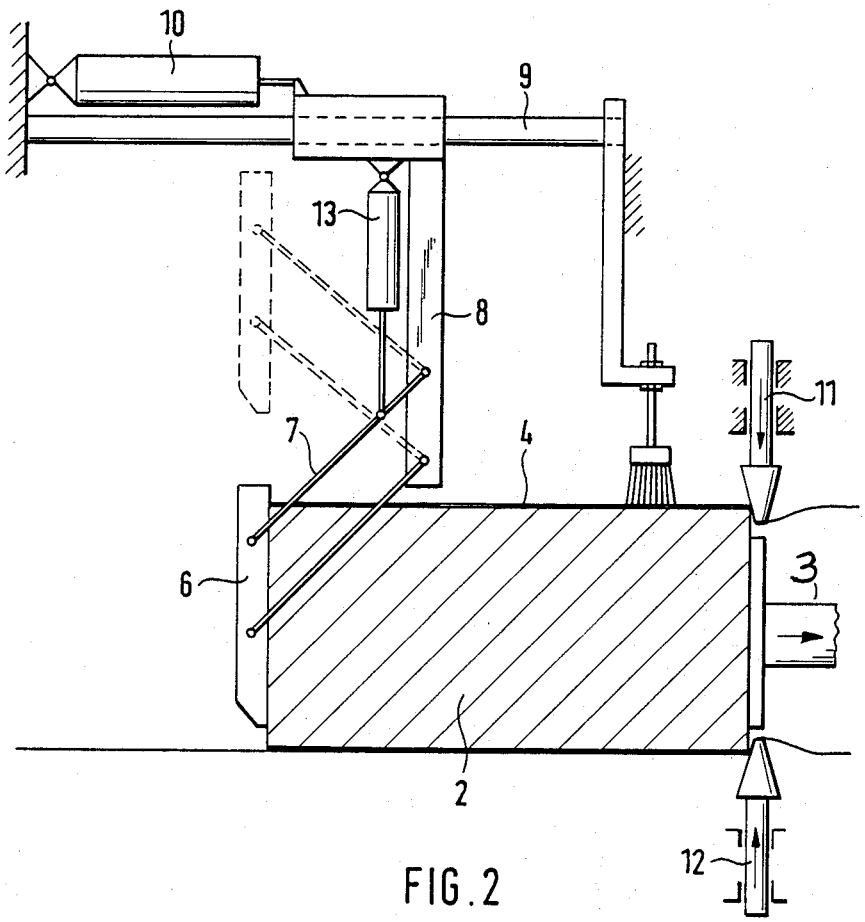

FIG. 2 illustrates the position of the bag 4 at the time the filling process is terminated. The push element 3 has reached its leftmost end position, at which it is flush with a pair of hold-back elements 11, 12 located, for example, approximately at the upper and lower side of the bag. The hold-back elements are then moved inwardly from the position shown in FIG. 1 to the position shown in FIG. 2 so that they will fit behind the last-inserted product 2. This permits the push element 3 to be moved towards the right, with respect to FIG. 2, while retaining the products 2 in compressed condition within the bag.

The bag is then sealed, in any suitable manner, not shown, for example by heat-welding or the like. Heat rails for welding plastic foil bags are not shown in the drawings and may engage, for example, from the top or the bottom, to close the projecting foil elements. The products are thus retained within the bag in compressed stiff alignment within the closed bag.

In many systems it is desirable to transport the now filled bag in the direction in which the bag was filled. To do so, the counter plate 6 is lifted upwardly by a fluid lifting cylinder 13, engaging for example the upper link of the linkage 7, to move the counter plate 6 in the position shown in broken lines in FIG. 2. This permits transport of the filled bag in any suitable manner, for example by a transport belt or the like.

The operation of the push element 3, of the hold-back elements 11 and 12 as well as of the cylinder-piston arrangement 10 and the lifting piston 13, and the timed operation of these elements to cause synchronized timed movement, is readily controlled by well-known sequencing systems, for example sequencing switches or the like, not further shown and described since such sequencing operations are standard in the art.

The arrangement has the advantage that the packaging of compressible goods 2, and particularly compressible paper goods, can be effected substantially tighter than heretofore so that the bags will be self-supporting and self-sustaining and can be easily stacked. The operating or cycling speed of the apparatus is not changed or delayed, since the operating sequence is matched to the feed of the bag, and to introduction of the articles thereinto.

The hold-back elements 11, 12 are particularly desirable and form an embodiment of the invention which has the advantage that they can be easily applied between retracted positions (FIG. 1) and projected positions, for example by compressed fluid, such as compressed air, with return springs or the like. The hold-back elements are first retained in the withdrawn position (FIG. 1) until the bag is introduced and the products are pushed thereinto. When the rear edge of the last group of products is past the hold-back elements, they are moved towards each other for sufficient distance to fit behind the last-inserted products. This permits the push element 3 to be withdrawn without, however, permitting the compressed articles 2 within the bag to expand. The hold-back elements are withdrawn towards the position shown in FIG. 1 only after the bag has been welded shut, in any suitable manner, and not shown in the drawings since such closing steps are well known in the Industry of bag manufacture. The filled bag is highly compact and tight and is so stable that a plurality of such filled bags can readily be stacked above each other, for example on pallets, or for display, and are capable of supporting considerable weight themselves.

The end hold-back elements 11, 12 can be projected to the position shown in FIG. 2 when the counter element 6 has reached a final or end position determined, for example, by the length of the cylinder-piston arrangement 10, beyond which it will be stopped. The compressive force exerted by the push element 3 is available to compress the articles to the desired extent. As long as the hold-back elements 11, 12 are engaged, the bag, after retraction of pusher 3, will be sealed, and the compressive ⟷force formerly created by the pusher is maintained between 6 and 11 resp. 12. After cooling of the sealing strip the counter element 6 can readily be swung into the position shown in broken line in FIG. 2. The compressive force exerted to the goods 2 is then force by the sealed bag.

The bag is then removed by means known per se, the counter element 6 is moved in the forward position shown in FIG. 1, the hold-back elements 11, 12 are also moved back and a new bag with goods i pushed in by pusher 3.

Various changes and modifications may be made within the scope of the inventive concept.

I claim:

1. Apparatus for packaging compressible articles or products (2), particularly paper towels, toilet paper or the like, in a foil bag (4) having a bottom wall, said apparatus having feeding means (3) for feeding, essentially horizontally, a plurality of said articles or products in a stacked group or assembly into the bag, and comprising means for compressing the compressible articles with a predetermined force so that, after filling of the bag, the bag can be sealed closed with the articles or products retained therein in compressed condition, including a counter abutment means (6) located outside of the bag and adjacent a bottom wall thereof, said counter abutment means being movable in the feeding direction of the articles or products;

a yielding force means weaker than said predetermined force of feeding the articles by said feeding means, acting on the counter abutment means (6) in a direction opposite the feeding direction of the feeding means to provide a yieldable counter force to the feeding means while causing compressing of the articles in the bag; and hold-back elements (11, 12) located adjacent an open end of the bag, opposite said bottom wall and said counter abutment means (6), and selectively engageable with the open end of the bag when the feeding means (3) has reached a terminal position in which all articles or products intended to be placed in the bag have been fed into the bag and retaining said compressible articles or products in compressed state to permit withdrawal of the feeding means and closing of the bag with the compressed articles or products therein.

2. The apparatus of claim 1, wherein said yielding force means comprises a compression cylinder-piston arrangement (10) having a movable element coupled to said counter abutment means and defining simultaneously a yielding path length for introduction of said compressible articles or products during which said yielding force is effective.

3. The apparatus of claim 1, further including a guide rail (9) and means (7, 8) coupling the counter abutment means (6) for slidable movement along said guide rail.

4. The apparatus of claim 2, further including a guide rail (9) and means (7, 8) coupling the counter abutment means (6) for slidable movement along said guide rail over said path.

5. The apparatus of claim 1, further including means (7) selectively retaining said counter abutment means (6) in position against the bottom of the bag (4) or removed therefrom to permit movement of the bag unrestrained by said counter abutment means in the direction of feeding of said articles or products after the bag has been filled.

6. The apparatus of claim 5, wherein said means supporting said counter abutment means comprises pivoting link means (7) and a fluid operated cylinder-piston arrangement (13) acting on said link means to pivot the counter abutment means between an interfering position with respect to movement of the bag and a released position, permitting unrestrained movement of the bag.

7. The apparatus of claim 5, further including a holding arm (8) pivotally retaining said link means, and movable in said direction opposite said feeding direction.

8. The apparatus of claim 1, further including hold-back elements (11) located adjacent an open end of the bag, opposite said bottom wall and said counter abutment means (6), and selectively engageable with the open end of the bag when the feeding means (3) has reached a terminal position in which all articles or products intended to be placed in the bag have been fed into the bag.

9. The apparatus of claim 1, wherein said hold-back elements comprise at least two hold-back fingers, movable from respectively opposite directions transverse to the feeding direction of said feeding means and behind the last-fed product or article within the bag.

10. The apparatus of claim 1, wherein said counter abutment means (6) comprises a plate element fitting against the bottom of the bag;

guide rail means (9) are provided, guiding movement of said plate element in the feeding direction under restraint of said yielding force means;

support means (7, 8) are provided, selectively supporting said plate element against the bottom of the bag for restraining movement of said bag under influence of said yielding force means or, selectively, releasing said bag for movement in said feeding direction, after having been filled;

wherein said yielding force means comprises a cylinder-piston arrangement; and wherein the hold-back elements (11, 12) are movable from respectively opposite directions toward the bag when the feeding means (3) is in a terminal position after introduction of all articles or products intended for insertion in the bag, said hold-back elements closing the bag behind the last introduced article or product, thereby retaining said articles or products under compressed condition in said bag.

* * * * *